United States Patent [19]

Juergens

[11] Patent Number: 4,752,012

[45] Date of Patent: Jun. 21, 1988

[54] CRANE CONTROL MEANS EMPLOYING LOAD SENSING DEVICES

[75] Inventor: Dieter Juergens, Bark River, Mich.

[73] Assignee: Harnischfeger Corporation, Brookfield, Wis.

[21] Appl. No.: 901,831

[22] Filed: Aug. 29, 1986

[51] Int. Cl.[4] ..... B66C 13/16

[52] U.S. Cl. ..... 212/154; 212/150; 340/685; 340/689

[58] Field of Search ..... 212/149, 150, 153, 154, 212/155; 340/685, 689; 73/862.56

[56] References Cited

U.S. PATENT DOCUMENTS

| | | | |
|---|---|---|---|
| 3,338,091 | 8/1967 | Tatum | 73/862.56 |
| 3,534,355 | 10/1970 | Fathauer | 212/155 |
| 3,638,212 | 1/1972 | Peter et al. | 212/155 |
| 3,713,129 | 1/1973 | Buchholz | 212/154 |
| 3,853,001 | 12/1974 | Mock | 212/155 |
| 4,178,591 | 12/1979 | Geppert | 212/155 |

FOREIGN PATENT DOCUMENTS

| | | | |
|---|---|---|---|
| 2802947 | 7/1978 | Fed. Rep. of Germany | 73/862.56 |
| 105304 | 10/1964 | Norway | 212/154 |

*Primary Examiner*—Joseph F. Peters, Jr.
*Assistant Examiner*—Thomas J. Brahan
*Attorney, Agent, or Firm*—James E. Nilles; Thomas F. Kirby

[57] ABSTRACT

A large mobile tower crane comprises a vertical multi-section lattice-type tower having its lower end fixedly mounted on the rotatable upper section of a self-propelled vehicle and a load-supporting multi-section lattice-type crane boom having its base end pivotally mounted on the upper end of the tower. A load to be lifted, swung and lowered, is attachable to a load line suspended from a pulley at the point end of the boom. The tower is selectively rotatable to swing the boom and the boom is selectively pivotable vertically to desired boom (luffing) angles. A crane control system employs strain gauge-type electronic sensing devices mounted on opposite lateral sides of the crane boom and on a side of the crane tower to provide electric signals pertaining to applied loads. A transducer provides an electric signal pertaining to boom angle. A programmable electronic computer, which processes these signals to calculate down load and side load moments in the boom and torque loads in the tower, provides output signals related thereto which are usable to operate the crane within safe limits. The output signals are usable to operate visual display devices which inform the crane operator of safe operating limits, or to effect automatic operation (subject to manual override) of certain crane functions (swinging, luffing, lifting) within safe limits. The sensing devices in the boom comprise strain gauges which are embodied in clevis bolts or pins which are located on opposite sides of the boom and which mechanically secure together certain sections of the multi-section boom. The strain gauge signals, which pertain to load magnitude in the boom, are added to determine load weight suspended from the boom, and are substracted to determine side load magnitude and direction.

18 Claims, 5 Drawing Sheets

CRANE CONTROL MEANS EMPLOYING LOAD SENSING DEVICES

BACKGROUND OF THE INVENTION

1. Field of Use

This invention relates generally to control means for large cranes, such as tower cranes which employ a swingable, luffable crane boom and a boom support tower.

In particular, it relates to a control means which employs load sensing devices to sense load conditions at various locations in the crane, which further employs a programmable electronic computer which calculates load moments at such locations, and which also provides output signals related to the load moments, which signals are usable to operate the crane within safe operating limits.

2. Description of the Prior Art

A typical mobile tower crane generally comprises a self-propelled vehicle, a boom support tower extending vertically or near vertically upwardly from the vehicle and mounted thereon for rotation about a vertical axis, and a crane boom extending horizontally outwardly from the boom support tower and mounted thereon for pivoting (luffing) about a horizontal axis. In operation, swinging of the crane boom is effected by rotating the tower left or right and luffing of the crane boom is effected by pivoting the crane boom up or down on the tower. In operation, a load to be lifted, swung and lowered is attached to a load line suspended from a pulley on the point end of the boom. The tower and boom are each on the order of 50 feet or more in length. Therefore, for weight reduction purposes and to facilitate set-up and disassembly of the crane on a job-site, the tower and boom each comprise a plurality of lattice-type sections which are mechanically joined end-to-end by removable pins or bolts. Such a crane, because of its large size and configuration, can be subjected to severe load conditions which can cause internal structural damage, such as bending or collapse of longitudinal chord members or cross braces of which the lattice-type sections are constructed, or even cause the crane to tip over. These severe load conditions can occur either while the crane is in operation or while the crane is stationary and not in operation.

In the following discussion, it should be understood that the load condition which is of concern is not merely the magnitude of a force applied at a certain point on the crane structure, but the load moment, i.e., the magnitude of the force times the distance between the point at which the force is applied and some known fulcrum point. The force can be a function of the weight or mass of the crane components, the weight or mass of the load being handled by the crane, the wind or other force acting on a side of the boom and the load, or any combination thereof.

Some of the most common operating practices or conditions which are likely to cause damage are: attempting to lift too heavy a load, operating a crane which is not properly leveled, attempting to lift a load while the boom is at an improper luffing angle with respect to the size of the load (i.e., too low); accelerating or decelerating too rapidly while raising or lowering a load or while hoisting or lowering the boom or while swinging the boom; unintentionally forcing the boom (vertically or horizontally) against some fixed object or structure, and securing the boom in such a position that side loads are imposed thereon by prevailing winds. Side loads are also induced in the boom due to deflection of the crane under structure and the deflection of the boom. Unacceptable forces can be applied to the boom alone and/or to the tower.

Crane manufacturers endeavor to take these factors into account when designing and building cranes so that a given crane will be in conformity with industry standards and OSHA regulations. Nevertheless, due to the complexity of the total crane structure, it is still possible to operate the crane beyond safe limits, operating instructions specifying certain not-to-exceed limits are provided for the operator and, in some cases, control systems are embodied in the crane either to warn the operator when he is about to exceed safe limits or to initiate certain control functions which automatically prevent safe limits from being exceeded Furthermore, some crane operators develop operating practices, based on experience, to aid them in staying within safe limits.

During crane operation, the boom is often subjected to side loads, as hereinafter explained. In a tower crane wherein tower rotation effects boom swing, the tower itself is subjected to torque loads generated by boom side loads. Side loads of sufficient magnitude can damage or collapse the boom or tower or both, especially in lattice-type cranes, or even overturn the crane. Side loads result from various causes, such as misalignment of the suspended load relative to the boom point end, or accidentally swinging the boom directly against some nearby object or structure location of the crane on uneven terrain, or wind.

As an example of load misalignment, when the boom is swung in a given direction (left or right) with a heavy load suspended therefrom, the initial horizontal motion of the boom "leads" the initial horizontal motion of the suspended load in the same direction. The load tends to "lag" because of inertia. This results in vertical misalignment between the boom point and the load hoist cable attachment point on the suspended load, i.e., the suspended load is initially out-of-plumb on one side of the boom point. Such misalignment imposes side loads on the lateral sides of the boom. More specifically, the structural members (such as chord members) defining the leading side of the boom (i.e., that side farthest from the misaligned load attachment point of the cable) are subjected to longitudinal tension forces. At the same time, the structural members (chord members) defining the lagging side of the boom (i.e., that side closest to the misaligned load attachment point of the cable) are subjected to longitudinal compression forces. When boom swing motion in the aforesaid given direction decelerates and/or stops, the horizontal motion of the suspended load continues in the aforesaid given direction. As a result, the suspended load then becomes out-of-plumb on the opposite side of the boom (i.e., the aforesaid leading side), and the side load on the boom becomes reversed, i.e., compression forces occur on the formerly leading side of the boom and tension forces occur on the formerly lagging side of the boom. As the suspended load swings or oscillates (with decreasing amplitude) relative to a motionless boom point, the side load shifts back and forth between the boom sides (in decreasing magnitude) until oscillation stops and the side load ceases to exist.

Side loads are of particular concern in large multi-section lattice-type booms wherein each lateral side is defined by elongated, usually tubular or angled steel, upper and lower chord members which are joined together at intervals therealong by tubular cross braces or lacing. In tower cranes where the boom is attached to the upper end of and rotatable with a large multi-section lattice-type tower, a side load on the boom generates corresponding torque in the tower, which exhibits itself as twisting of the vertically disposed longitudinal tubular chord members of the tower and compression and tension forces in the cross-braces interconnected between the chord members.

Generally speaking, and assuming a suspended load of given weight suspended by a load hoist cable from the boom point end, side load magnitude increases as a function of any or all of the following factors: an increase in boom length, an increase in boom elevation angle, an increase in the vertical distance between the boom point end and the suspended load attachment point (load hoist cable length), an increase in the rate of acceleration or deceleration of boom swing motion, wind loads, out-of level conditions, or any combination of these factors. Federal OSHA regulations and industry standards specify the type and magnitude of various loads a crane must be able to withstand. In addition, operating data based on calculations and field tests of specific cranes are furnished to the crane operator and define permissible limits of various boom positions and operations (and combinations thereof) which would affect side loading, such as boom hoist angle limits, boom swing position limits, swing acceleration and deceleration rates, load weight limits, levelness and so forth. However, even with such data, practical experience in crane operation is essential to avoid exceeding permissible limits. Frequently, the crane operator develops operating practices based on his experience and knowhow to aid him in staying within limits. For example, one useful practice developed and employed by some operators of small and medium sized cranes is for the crane operator or his assistant to observe or "sight" the angular position of the load line relative to the vertical axis of the crane boom and to control boom swing motion (acceleration and deceleration) so that the load line never goes out-of-plumb for a distance greater than the width of the widest portion of the boom. However, this practice of "sighting" is safe only if the crane is level and is entirely unsuited for large cranes, especially tower cranes, wherein a long boom (on the order of 50 or more feet in length) is mounted on the top of a high vertical tower or mast (on the order of 50 or more feet in height) and visual cues are difficult or impossible to obtain.

Therefore, there is need for a means or system for sensing actual side load conditions and other relevant conditions and for providing this information in a form which can be used by the crane operator to operate the crane within acceptable safety limits.

The prior art discloses various types of load sensing systems and devices for use on cranes. However, insofar as applicant is aware, no system is known, disclosed or available for sensing crane boom side loads and for providing data relative thereto, alone or in combination with other relevant data, such as boom angle and load weight, on which crane operation can be based. The prior art also does not disclose side load sensing systems which consider torque loads imposed on crane towers as a result of boom side loads. The following patents generally illustrate the state of art of sensing systems used in cranes and other machines to sense various loads, load moments and stresses: U.S. Pat. Nos. 3,505,514; 3,638,211; 3,695,096; 3,740,534; 4,535,899 and 4,532,595.

This prior art discloses various types of sensors or transducers to sense conditions at various locations (i.e., boom angle, load) and discloses various types of electronic computers to calculate loads and/or load moments and provide output signals which are usable alone or in conjunction with other data. Some of the prior art patents use various types of visual displays to guide the operator. U.S. Pat. Nos. 4,532,595 and 3,638,211 employ a strain gauge type sensor in cables which are employed in the crane to sense loads at certain points. U.S. Pat. No. 3,695,096, like U.S. Pat No. 3,638,211, discloses a strain gauge embodied in a bolt or pin used to secure two mechanical components together. The prior art patents are primarily concerned with measuring loads or load moments acting on the boom in a vertical plane, with the boom at some known luffing angle, although some other conditions are sensed as well.

SUMMARY OF THE PRESENT INVENTION

In accordance with the present invention, there is provided a large mobile tower crane which comprises a vertical or near vertical tower having its lower end fixedly mounted on the rotatable upper section of a self-propelled vehicle and a load-supporting crane boom having its base end pivotally mounted on the upper end of the tower. A load to be lifted, swung and lowered, is attachable to a load line suspended from a pulley at the point end of the boom. Both tower and boom are of multisection lattice-type construction to reduce weight and facilitate set-up, disassembly and transport. The tower rotates in either direction to swing the boom and the boom pivots vertically on the tower to desired boom (luffing) angles between horizontal and near-vertical positions. Means are provided to selectively rotate the tower and to selectively pivot the boom. A crane control system employs electronic sensing devices mounted at predetermined locations on the crane boom and on the crane tower to provide electric signals pertaining to crane load conditions. A transducer provides an electric signal pertaining to boom angle. These signals are fed to a programmable electronic computer which processes them to calculate load moments in the boom and torque loads in the tower and provides output signals related to load moments in the boom and torque loads in the tower which are then usable to operate the crane within safe limits. The output signals are usable in either or both of two ways, namely: to operate visual display devices which inform a human operator of safe operating limits as he operates the crane, or to effect automatic operation (subject to manual override) of certain crane functions (swinging, luffing) within safe limits. The sensing devices in the boom comprise strain gauges which are embodied in clevis bolts or pins which mechanically secure together certain sections of the boom. The strain gauge signals pertain to magnitude and direction of loads imposed at the predetermined locations. Two load sensing devices located on opposite sides of the boom at a predetermined distance from a known fulcrum point are used to sense the total weight of a load suspended from the boom, and are also used to sense side loads imposed thereon. A sensing device in the crane tower senses torque loads imposed on the tower as the boom is swung or subjected to side loads. The load sensing devices provide data pertaining to magnitude and direction of applied forces. The computer, which is programmed to "know" the predetermined location of each sensing device, the distance between the point where the load is applied (i.e., point end of boom) and some predetermined fulcrum point (i.e., base end of boom), and which takes into account boom angle when necessary, calculates the load moments (load magnitude times load radius from a known point), and provides output signals usable to ascertain safe load moment limits.

The pair of load-sensing devices on the boom provide input signals representative of the magnitude and direction of the load. The programmable computer receives and operates upon the input signals and provides output signals representative of total load weight on the boom, any side load, boom angle, and tower torque. The visual display for the side load depicts the permissible limits of boom swing position in view of the actual boom hoist angle and also depicts actual boom swing position relative to such limits, i.e., the magnitude and direction of the side load. The torque load-sensing device, for sensing torque imposed on the tower by the boom when the latter is subjected to a side load, provides a signal representative of the magnitude and direction of the torque. The transducer or inclinometer for sensing the luffing angle of the boom provides a signal representative thereof.

The two load-sensing devices on the boom are mounted on opposite lateral sides thereof for sensing compression and tension forces occuring in those sides when the boom is subjected to a downward load and/or to a side load. In a multi-section lattice-type boom, the side load-sensing devices take the form of commercially available clevis pins or bolts having a piezo-electric stress-detectors therein (hereinafter called "sensor pins"). These sensor pins are located at and are part of a mechanical joint between two adjacent boom sections, which joint is as near as possible to the base end of the boom. The tower has lateral tower sides and the torque load-sensing device senses compression and tension forces occurring in at least one side of the tower (i.e., in a cross brace thereof) as a result of torque in the tower when the boom is subjected to a side load.

The programmable computer is provided with stored data pertaining to the size and operating characteristics of the particular crane boom and tower, and the predetermined location of the load-sensing devices relative to a fulcrum point. The computer employs this stored data in conjunction with incoming signals from the various sensing devices and angle transducer to determine and provide output signals representative of safe operating limits for the boom.

The visual display device for indicating the side load provides a display wherein two movable indicator needles assume spaced-apart positions representative of side load direction and magnitude (in view of actual boom angle). The crane operator manually controls boom motion in accordance with the display. The optionally usable automatic control circuits, which can be overridden the operator's manual control inputs, utilize the output signals from the computer to effect movement of said boom in accordance therewith.

When the system is applied to a crane in which no tower is employed, the torque sensing means and the processing of a torque signal are not required. The system can also be used to detect side loads in an elementary form of crane in which the crane boom cannot be raised or lowered and there is no signal representative of boom angle for use by the computer.

A crane boom control means or load sensing system in accordance with the invention offers numerous advantages. For example, it provides objective, factual and quantified information regarding the occurrence, direction and magnitude of side loads acting on a crane boom, and eliminates guess-work on the part of the crane operator. It takes into account the effect of boom angle in calculating load moments of a down load or a side load. If used in a tower crane, it takes into account the torque applied to the tower as a result of a boom side load. The information is available in visual display form for guidance of the crane operator in manual control of the crane, or in control signal form to automatically control boom motions. In some cases, automatic control reduces the risk of human error and ensures rapid corrective response to possible or actual dangerous load conditions which are detected, but manual override is possible. The system can be installed during crane manufacture or can be retro-fitted on cranes already in the field. The basic system comprises a programmable computer which is programmable to take into account the operating characteristics of each particular crane to which it is applied. The system, in the preferred embodiment, uses commercially available sensor devices which perform a necessary mechanical function (mechanically joining two adjacent sections of the boom), as well as an electrical sensing function for detecting loads, thus making use of structural features already embodied in the crane boom and thereby reducing manufacturing and assembly costs. The system preferably presents a visual display for the operator which is analogous in appearance to the structural arrangement and motion of the crane boom itself and thereby simplifies and speeds interpretation on the part of the operator as to what corrective action to take. Audible warning means can be provided to supplement the visual display. The system is straight-forward in design, reliable in use, and relatively economical to manufacture, install and service, considering the cost of repairing possible damage to the crane which could occur in the absence of the system. The system employs electronic components throughout and a minimum number of electro-mechanical components which are typically subject to wear and breakdown. Other objects and advantages will hereinafter appear.

DRAWINGS

DESCRIPTION OF PREFERRED EMBODIMENTS

General Arrangement

Figure 1:
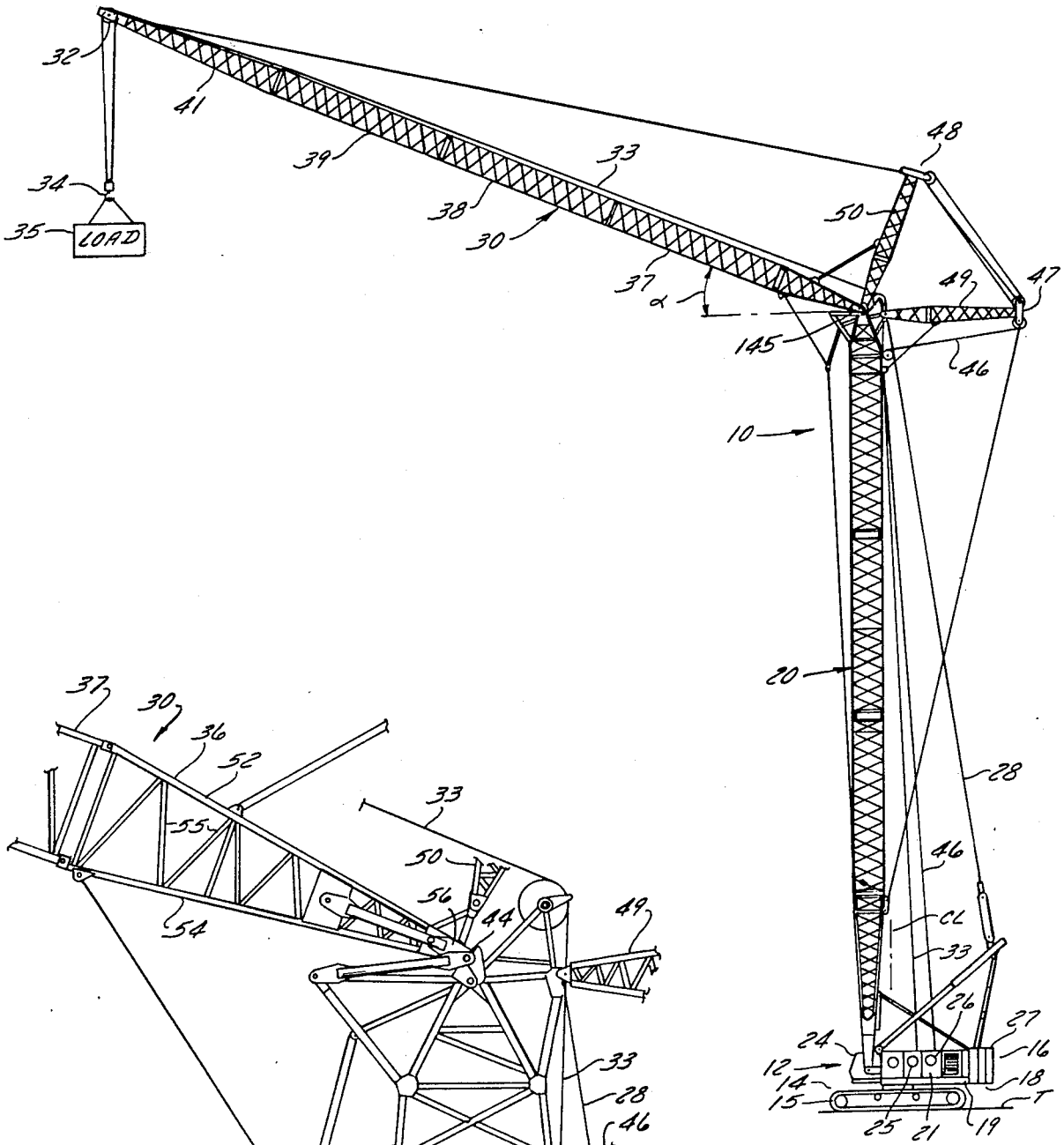
FIG. 1 is a side elevation view of a mobile tower crane having crane control means employing load sensing devices in accordance with the present invention.
Figure 2:
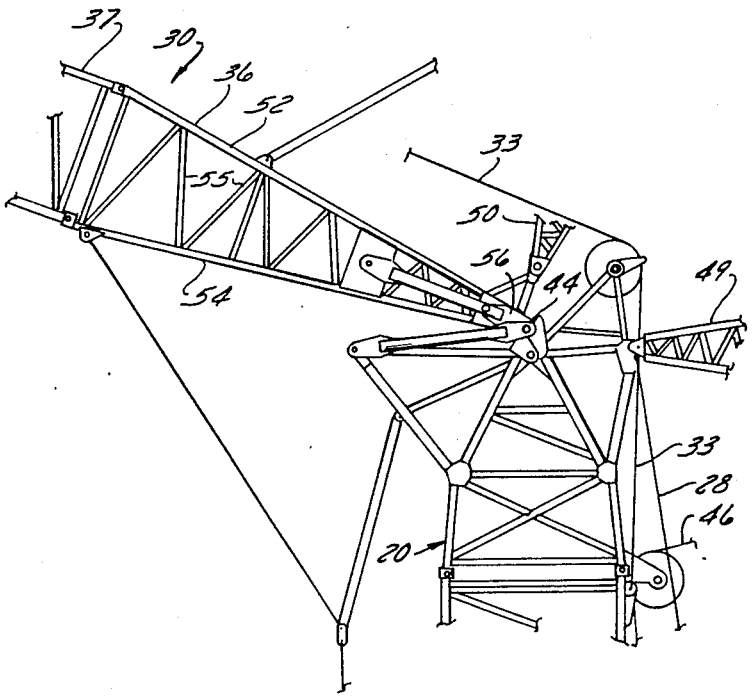
FIG. 2 is an enlarged side elevation view of the top end of the crane tower and the base end of the crane boom shown in FIG. 1.
Figure 3:
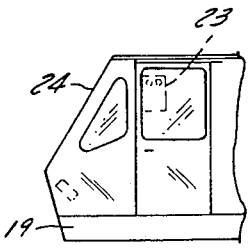
FIG. 3 is an enlarged side elevation view of the crane operator's cab shown in FIG. 1 and shows the operator's control panel of the crane control means.
Figure 4:
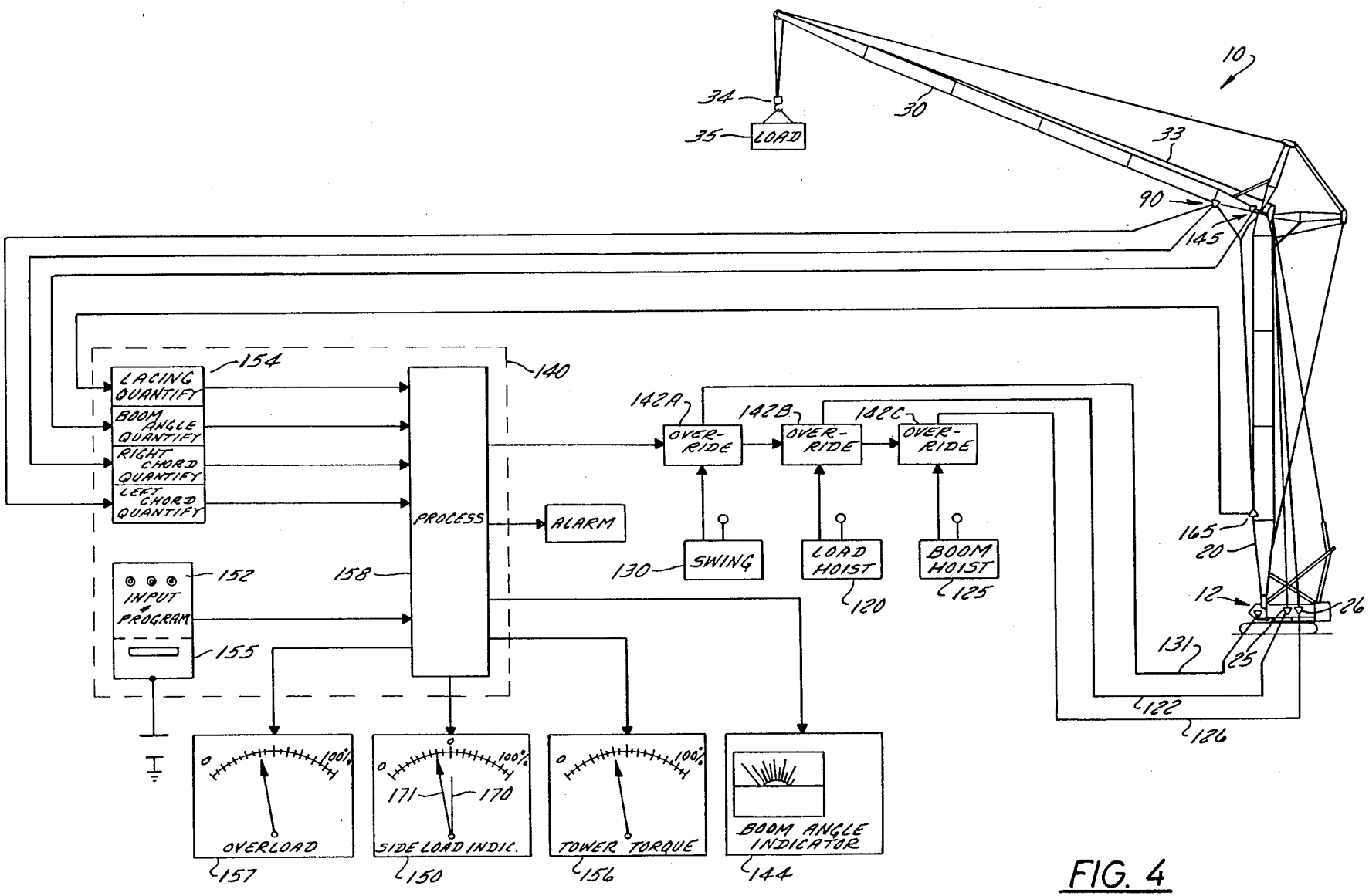
FIG. 4 is a schematic view of the crane shown in FIG. 1 and of the crane control means therefor.

Referring to FIGS. 1 and 4, a mobile tower crane 10 comprises a self-propelled vehicle 12, an upwardly vertically extending multi-section crane tower 20 rotatably mounted on the vehicle, and a generally horizontally extending multi-section crane boom 30 mounted on the tower for pivotal movement in a vertical plane and adapted to raise and lower a load 35 suspended by a load line 33 from its point end. Drive means are provided to rotate tower 20 to swing boom 30, to pivot the boom to a desired luffing angle $\alpha$, and to operate load line 33 to raise and lower suspended load 35. Control means are provided to sense loads being imposed at predetermined locations 59 and 60 on boom 30 and at location 166 on tower 20. A computer 140 calculates the magnitude and direction of the load moments at boom locations 59 and 60 resulting from such loads, and provides output signals which are usable to operate the drive means (either manually or automatically) to control swinging, luffing and load-lifting operations of crane 10 so as to maintain the load moments below some predetermined value which might cause structural damage to or tipping of crane 10. The control means comprise two load sensing devices 90, one at each location 60 and 59 on each lateral side 80 and 81 of crane boom 30; a transducer 145 which senses boom angle $\alpha$; a load sensing device in crane tower 20; and programmable computer 140 which receives and processes electrical signals from the two sensing devices 90 and boom angle transducer 145 and provides output signals pertaining to the magnitude and direction of any load moments at the locations 59 and 60, as well as tower torque loads. The computer 140 utilizes the known distance between a point where the maximum load is applied and a predetermined fulcrum point to calculate the load moment and, in the case of the two load sensing devices 90 on boom 30, this calculation takes into account how the known distance is affected by boom angle $\alpha$. These output signals operate visual display devices 144, 150, 156 and 157 which inform the crane operator of crane operating conditions so that he can operate the crane drive means within safe limits. These output signals are optionally usable to operate the crane drive means automatically within safe limits. The output signals indicate: on display device 157 the magnitude of the load moment of a load being hoisted by boom 30; on display device 150 the magnitude and direction of any side load moment imposed on boom 30 by a misaligned load being hoisted, or by wind, or by an obstruction acting against a side of the boom; on display device 156 the magnitude of any torque force imposed on crane tower 20 by swinging of boom 30; and on display device 144 the boom angle $\alpha$. The computer 140 adds the two load moments derived from the two signals provided by the two loading sensing devices 90 on boom 30 to calculate the total load moment of a load 35 being hoisted to warn of an impending overload. The computer 140 subtracts these same two load moments to calculate the load moment of any side load on boom 30.

Crane Structure

Referring to FIG. 1, numeral 10 designates a crane 10 which employs crane control means which is depicted schematically in FIG. 4. Crane 10 is a large mobile lattice-type tower crane which comprises a self-propelled vehicle 12 having a lower section 14 on which endless motor-driven tracks 15 are provided to enable it to move over terrain T. Vehicle 12 also comprises an upper section 16 which is mounted for horizontal rotation in opposite directions on lower section 14 by means of a conventional slewing ring assembly 18. Upper section 16 comprises a platform 19 on which are mounted an upright crane boom support mast or tower 20 (about 100 feet high), an engine housing 21 containing an engine 22 and other accessories, an operator's cab 24 containing various manually operable controls for crane operation and a control panel 23 (see FIG. 4), a load hoist winch 25, a boom hoist winch 26, a counterweight 27, and rigging lines 28 to support mast 20.

A crane boom 30 (about 120 feet long) has its base end pivotally connected to the top end of tower 20 so that the boom can be raised and lowered and has a load line pulley 32 at its point end about which a load supporting line or cable 33 is reeved. Cable 33 has one end wrapped around winch 25 and is provided at its other end with a load attachment hook 34 by means of which a load 35 is suspended from the point end of boom 30. Boom 30 is a multi-section lattice-type crane boom comprising a base section 36, three intermediate sections 37, 38 and 39, and a point section 41 which are rigidly joined together end-to-end by clevis-type joints, as hereinafter described. The base section 36 at the base end of boom 30 is pivotally connected to the top end of boom support mast 20 by boom pivot pins 44 and can be adjustably raised or lowered (luffed) in a vertical plane about the pivot pins 44 by means of a boom hoist line system 46 which has its lower end connected to boom hoist winch 26 and its upper end connected to the point end of boom 30. The boom hoist line system 46, which also operates to support boom 30, is connected to pulley assemblies 47 and 48 which are mounted on the outer ends of support masts 49 and 50, respectively, which are mounted on the top end of boom support mast 20.

In a typical operation of crane 10 at a job-site, the lower section 14 of vehicle 12 is stationary, boom 30 is pivoted to and maintained at some desired boom or luffing angle in response to operation of boom hoist winch 26, suspended load 35 is raised and lowered in response to operation of load hoist winch 25, and boom 30 is swung right or left for a desired distance at a desired rate of speed in response to operation of a swing motor (not shown) connected to slewing ring assembly 18 which effects rotation of crane upper section 16 and tower 20 thereon. As FIG. 1 makes clear, upper section 16 of vehicle 12 rotates on a vertical centerline, but the vertical axis of tower 20 is offset from the centerline and the base end of boom 30 is also slightly offset from the vertical centerline. Therefore, the base end of boom 30 is rotated or swung right or left to desired positions.

Crane Boom

The construction of boom 30 will now be described in more detail. Referring to FIGS. 1, 2, 7, 8, 9, 11 and 12, crane boom base section 36 is pyramidal in shape and comprises two tubular steel top chord members 51 and 52 and two tubular steel bottom chord members 53 and 54. A plurality of tubular steel cross-brace or lacing members 55 are welded between the various chord members. Two rigid steel end plate assemblies 56 are provided to which the inner ends of the four chord members are welded and to which the boom pivot pins 44 (FIG. 2) are connected. Top chord member 51 and bottom chord member 53 and the lacing therebetween define one (right hand) lateral side of boom base section 36. Top chord member 52 and bottom chord member 54 define the other (left hand) lateral side of boom base section 36. Four clevis joints 57, 58, 59 and 60 (only three visible in FIGS. 7 and 8) are provided at the outer ends of the four chord members 51, 52, 53 and 54, respectively. These clevis joints serve as an end-to-end mechanical connection between boom base section 36 and its adjacent intermediate boom section 37. Boom section 37 comprises two tubular steel top chord members 61 and 62 and two tubular steel bottom chord members 63 and 64 (only 64 visible in FIG. 7) and lacing members 65 are welded between the various chord members. Top chord member 61 and bottom chord member 63 and the lacing therebetween define one lateral side of boom base section 36. Top chord member 62 and bottom chord member 64 define the other lateral side of boom base section 36. Intermediate boom sections 37, 38 and 39 are similar in construction to boom base section 36. Thus, crane boom 30 has two laterally spaced apart sides generally designated 80 and 81 in FIG. 8, hereinafter sometimes referred to as the left side and the right side, respectively, of boom 30.

Figure 12:
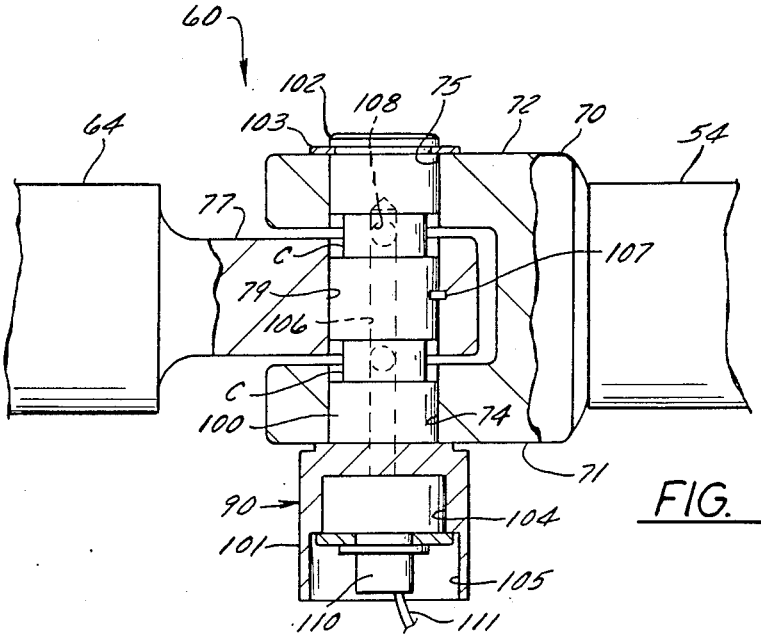
FIG. 12 is a cross-section view, taken on line 12—12 of FIG. 8, and showing the clevis pin and sensor of FIG. 11.
Figure 11:
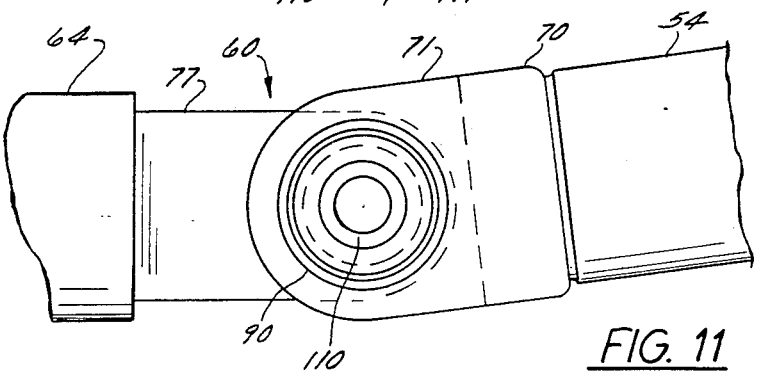
FIG. 11 is a greatly enlarged side elevation view of the clevis pin shown in FIG. 7 and embodying a sensing device.

Referring to FIGS. 11 and 12, it is to be understood that each clevis joint 57, 58 and 59 is similar to clevis joint 60. Clevis joint 60 comprises a U-shaped member 70 which is welded to the outer end of its respective chord member 54 of boom base section 36. Member 70 has two spaced apart legs 71 and 72 which have aligned circular holes 74 and 75, respectively, therein. Clevis joint 60 further comprises a tongue member 77 which is welded to the inner end of chord member 64 of intermediate boom section 37 and which has a circular hole 79 therein. Tongue member 77 is disposed between the legs 71 and 72 of U-shaped member 70 so that the holes 79, 74 and 75 (which are of the same diameter) are in alignment. It is to be understood that the aligned holes in the two upper clevis joints 57 and 58 shown in FIG. 8 receive conventional nut-and-bolt assemblies 85 and 86, respectively, which complete the joint and mechanically connect together top sides of the adjacent boom sections 36 and 41. As will be further understood, all other clevis joints in crane boom 30, except clevis joints 59 and 60, are substantially the same as above-described joints 57 and 58.

Load Sensing Devices

However, in accordance with the invention, the aligned holes 79, 74 and 75 in each of the two lower clevis joints 59 and 60 receive a load sensing clevis bolt or clevis pin 90 shown in cross-section in FIG. 12. The clevis pin or bolts 90 in joints 59 and 60 serve dual functions: first, to mechanically connect together the bottom sides of adjacent boom sections 36 and 41, and, second, to sense load forces acting on crane boom 30 (either vertically or horizontally) and transmit signal information pertaining thereto, as hereinafter described. Load sensing clevis pin 90 is a commercially available device and its structure and mode of operation is described in prior art patent No. 3,695,096 hereinbefore referred to. As FIG. 12 shows, each sensing pin 90 comprises a generally cylindrical hardened metal body 100 having a head portion 101 at one end and a grooved portion 102 at its opposite end for receiving a retaining ring 103 which secures it in its respective clevis joint 60. Body 100 has a cavity 105 in its head which communicates with an axial bore 106 extending into the body. Bore 106 accommodates two strain gauges 108 which are electrically connected to an electrical connector socket 110 which is mounted in cavity 105 to enable electrical wires 111 to be connected between the strain gauges and other electrical components in the system.

As FIG. 12 shows, the strain gauges 108 are sealed inside the small axial hole 106 and are located at two different depths corresponding to zones "C" of the pin. In order to sense only those strains which are induced by the shear forces at these two sections, the gauges are positioned and oriented with great precision at a neutral plane relative to one specific direction of pin loading. The two strain gauges at each location 59 and 60 are electrically connected to form a full bridge, the signal from each gauge being additive so that the bridge output is proportional to the sum of the loads transmitted by the two shear planes of the pin. The circuit includes temperature compensating, signal trim and balance resistors (not shown) terminating in connector socket 110, and potted with sealing compound inside cavity 105.

To prevent rotation of pin 90 relative to an applied load direction is necessary and a projection or pin 107 prevents such rotation by keying the clevis eye 77 to pin 90. Or, one could position the strain gauge pin with a keeper plate on the pin to prevent rotation, or use other means to prevent rotation.

Figure 10:
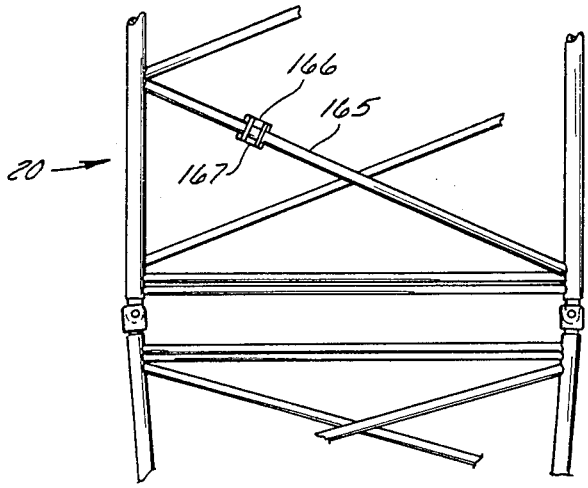
FIG. 10 is an enlarged side elevation view of a portion of two adjacent sections of the support tower of the crane of FIG. 1.

As FIG. 10 shows, sensing device 166 for sensing the torque force applied to crane tower 20 takes the form of a strain gauge 167 which is embodied in device 166. Device 166 is mounted in or on a cross brace 165 which forms part of the lattice-type structure of tower 20. Preferably, device 166 is located near the base end of tower 20. It is to be understood that, as tower 20 twists in response to a side load imposed on crane boom 30, device 166 senses whether a compression or tension force is being applied to cross brace 165 and this indicates to computer 140 the direction and magnitude of the torque force. The torque signal is converted to a value which is displayed on visual read-out device 156 and provides information of this fact to the crane operator who can then adjust boom motion accordingly so as to stay within safe torque limits for tower 20.

Down Load Sensing Operation

Figure 6:
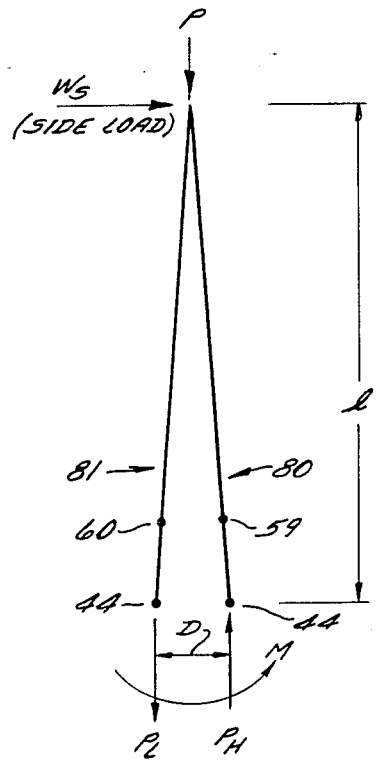
FIG. 6 is a simplified schematic diagrammatic top plan view of the crane boom of FIG. 5 and shows side load forces applied thereto.
Figure 5:
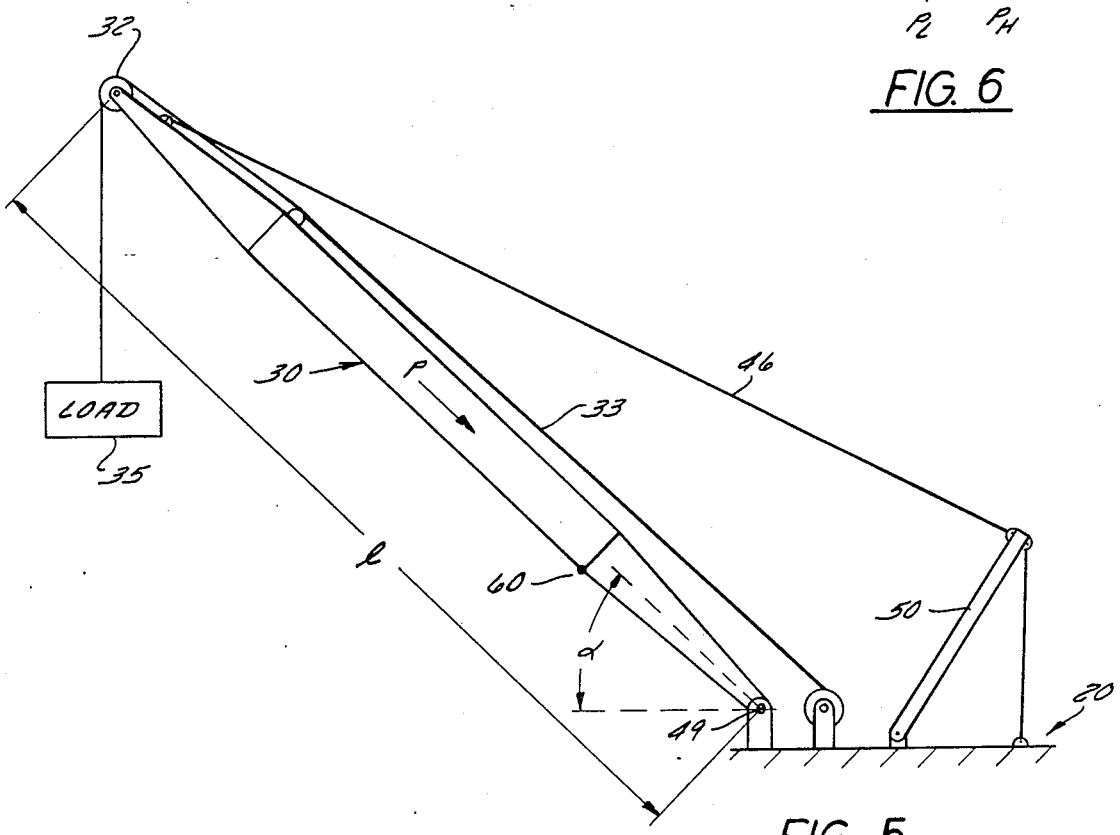
FIG. 5 is a simplified schematic diagrammatic side view of an ideal crane boom and shows the forces applied thereto.
Figure 8:
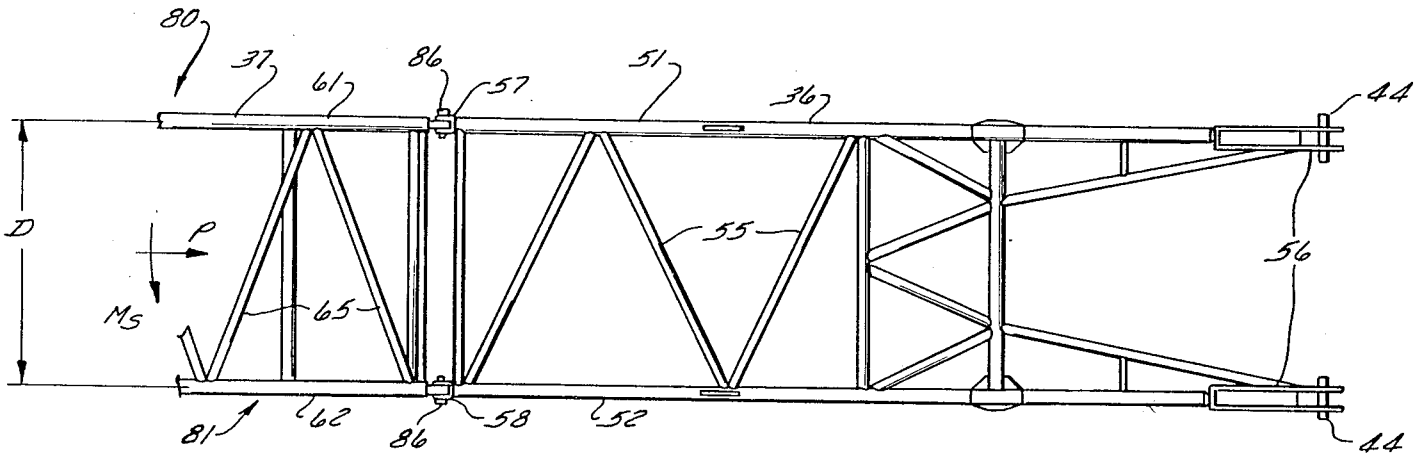
FIG. 8 is a top plan view of the structure shown in FIG. 7.
Figure 7:
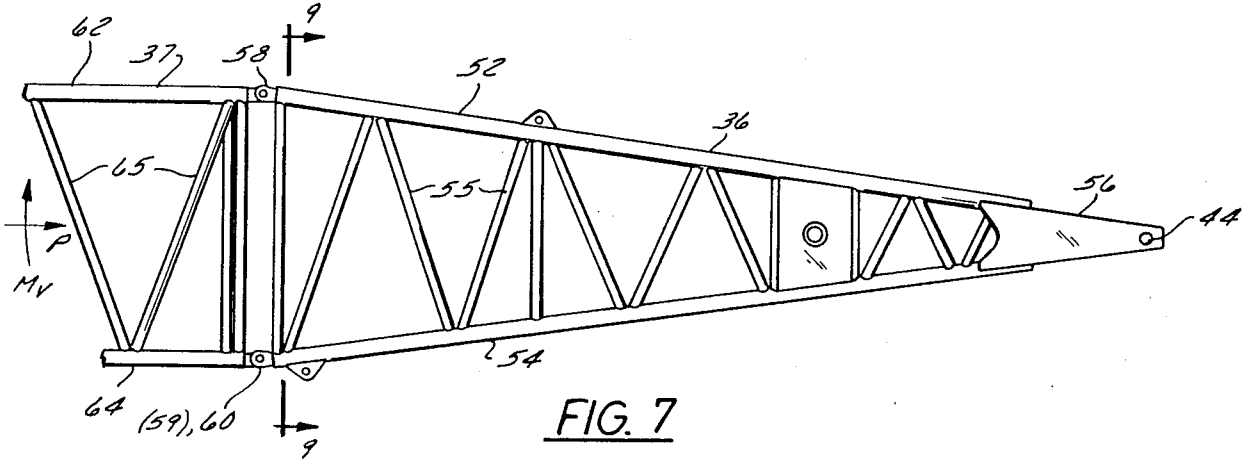
FIG. 7 is an enlarged side elevation view of the crane boom base section and a portion of an adjacent crane boom section shown in FIGS. 1 and 2.
Figure 9:
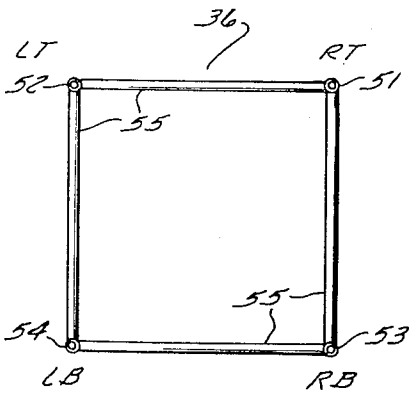
FIG. 9 is a cross-section view taken on line 9—9 of FIG. 7.

Referring to the schematic diagrams in FIGS. 5 and 6, FIG. 5 shows that load 35 on load line 33 exerts a downwardly acting force P on boom 30. At the same time, boom 30 is subjected to a downward bending moment causing compression forces in the underside of the boom and tension forces on the upper side of the boom. The sensors at the locations 60 and 59 near the base of boom 30 sense the magnitude of the compression force and computer 140 calculates the load moment of each force and adds them to determine the total downward bending moment acting on boom 30. The load moment is, of course, a function of the length l of boom 30 and the luffing angle $\alpha$. Computer 140 is programmed to "know" boom length l and tranducer 145 senses angle $\alpha$. As angle $\alpha$ increases or decreases, the load moment decreases or increases, respectively.

Side Load Sensing Operation

Referring to FIG. 6, it will be apparent that a side load force Ws applied to side 81 of boom 30 generates tension forces or stresses in side 81 and compression forces or stresses in side 80 of boom 30. These stresses, or side load moments, are greatest at the base of boom 30. Assuming a side load force Ws of fixed magnitude, these stresses will increase if force Ws is applied nearer the point end of the boom and will decrease if force Ws is applied nearer the base end of the boom. Furthermore, assuming a side load force Ws of fixed magnitude and applied at a certain point on boom 30, and assuming a boom of a fixed known length l, the stresses (side load moment) will increase as boom angle $\alpha$ decreases and will decrease as boom angle $\alpha$ increases. Boom angle $\alpha$ is the angle between a horizontal plane and the boom axis. Normally, the load 35 is the largest when $\alpha$ is large and load 35 is smallest when $\alpha$ is small. Side loads are changing in the same way. The stresses in the chords are the highest when $\alpha$ is the largest (compressive+side load). Therefore, it is desirable to locate the two sensing devices 90 as close as is practical to the base end of boom 30. Since it is important that the sensing devices 90 do not rotate when installed, it is not desirable to locate them at the boom pivot point, i.e., at the same location or in place of boom pivot pins 44. There are also other reasons for not locating the pins 90 at the pivot point: strain gauge pins require a tight fit to give accurate measurements, whereas boom foot pins require a somewhat loose fit to enable movement. Instead they are located at the clevis joints 59 and 60 which are relatively close to the boom base end and where they can perform a needed mechanical function, as well as a sensing function at a key location.

General Arrangement of Controls

As FIG. 4 shows, the crane operator is provided with the following control levers which are located in cab 24, namely: a lever-operated load hoist control 120 which is connected by a control circuit 122 to a motor (not shown) which operates load hoist winch 25 to raise and lower suspended load 35; a lever-operated boom angle (boom hoist) control 125 which is connected by a control circuit 126 to a motor (not shown) which operates boom hoist winch 26 to raise and lower boom 30; and a lever operated boom swing control 130 which is connected by a control circuit 131 to a motor (not shown) which operates to effect swing motion of crane upper section 16 and crane boom 30. The following components are also located in cab 24, namely: programmable computer 140 supplied with electric power from a suitable power source, such as an electric generator or alternator (not shown) driven by the crane engine (not shown); override circuits 142A, 142B and 142C connected to computer 140 and by means of which the operator's manual control inputs to controls 130, 120 and 125, respectively, can override automatic control when certain load conditions so require. The display devices 144, 150, 156 and 157 are also located in cab 24.

As FIG. 4 shows schematically, programmable computer 140 comprises manually operable switches, generally designated 152, which enable the load sensing system to be turned on and off, which enable the manual override circuits to be actuated or by-passed, and which enable computer 140 to be programmed with data.

Computer 140 receives output signals from the two side load sensing devices 90 and output signals from the boom angle sensing device 145. Computer 140 provides output signals to operate the display devices 144, 150, 156 and 157 and to effect automatic control, if selected.

As FIG. 4 shows in schematic block form, computer 140 comprises the following internal operational circuits or sections, namely: circuits 154 which quantify the incoming data from the output signals from the three sensing devices and the transducer; a memory circuit 155 for storing program data pertaining to system parameters; and a processing circuit 158 for the quantified signals and provides output signals in a form usable by the display devices and the automatic control circuits.

Side load display device 150 takes the form wherein said visual display includes a movable indicator 170. Movable indicator 170 has a zero or null center position indicative of no side load applied to crane boom 30 and is movable in either direction from said null position to a 100% position to indicate the direction of side load imposed on crane boom 30. Indicator 171 indicates on the scale the magnitude of the side load (at some point from "0" to "100%").

I claim:

1. In a crane:

a support;

a boom mounted on said support for lateral swinging movement and having opposite lateral sides drive means operable to effect said lateral swinging movement of said boom;

and control means for sensing a side load imposed laterally on said boom, for determining the magnitude and direction of the side load moment, and for providing an electrical output signal to operate said drive means to move said boom laterally to maintain said side load moment below a predetermined magnitude, said control means comprising side load sensing means on at least one lateral side of said boom for providing electric signals representing magnitude and direction of a side load, said control means further comprising computer means for receiving and processing said electrical signals from said side load sensing means to ascertain said side load moment and for providing said electrical output signal to operate said drive means.

2. A crane according to claim 1 wherein said control means comprises side load sensing means on opposite lateral sides of said boom for sensing compression and tension forces occuring in said opposite lateral sides of said boom when a side load is imposed on said boom.

3. A crane according to claim 2 wherein said side load sensing means mounted on said opposite lateral sides of said boom each provide an electric signal, and wherein said computer means compares said electric signals from said side load sensing means to ascertain differences in the magnitude and direction thereof in order to provide an electrical output signal indicative of any side load moment to operate said drive means.

4. A crane according to claim 3 wherein said boom comprises at least two separable boom sections arranged end-to-end and wherein said load sensing means comprise load sensing devices which are disposed between said two boom sections.

5. A crane according to claim 4 wherein said load sensing devices are embodied in mechanical components which mechanically join together said two boom sections.

6. In a crane:

a support;

a boom mounted on said support;

first drive means operable to effect swinging movement of said boom;

second drive means operable to effect luffing movement of said boom;

and control means for said crane comprising:

load sensing means mounted on said boom for sencing loads imposed on said boom, including any down load and any side load, and for providing electrical signals indicative of the magnitude and direction of said loads;

transducer means for sensing the luffing angle of said boom and for providing an electrical signal indicative of said luffing angle;

and computer means for receiving said electrical signals from said load sensing means and the electrical signal from said transducer means and for providing output signals representing the magnitude and direction of any load moment on said boom, including the magnitude and direction of any side load moment acting on said boom, and further including the magnitude of a downwardly acting load moment on said boom, said output signals effecting operation of either or both of said drive means to move said boom to maintain any load moment below a predetermined magnitude.

7. A crane according to claim 6 wherein said computer means further provides output signals representing the boom angle of said boom.

8. In a tower crane:

a tower;

a boom mounted on said tower for vertical pivotal movement;

first drive means operable to effect rotation of said tower to effect swinging movement of said boom;

second drive means operable to effect vertical pivotal luffing movement of said boom relative to said tower;

and control means for said crane comprising:

boom load sensing means mounted on said boom for sensing the magnitude and direction of a load imposed at a predetermined location on said boom and for providing electrical signals indicative of said magnitude and direction of said load;

transducer means for sensing the luffing angle of said boom and for providing an electrical signal indicative of said luffing angle;

torque load sensing means mounted on said tower for sensing the magnitude and direction of a load imposed at a predetermined location on said tower and for providing electrical signals indicative of the magnitude and direction of the torque load imposed on said tower;

and computer means for receiving the electrical signals from said boom load sensing means, for said torque load sensing means, and from said transducer means and for providing output signals representing the magnitude and direction of any load moment imposed on said boom, including a down load moment and a side load moment, at said predetermined location on said boom, and representing the magnitude and direction of any torque load moment imposed on said tower, said output signals being usable to operate either or both of said drive means to move said boom to maintain the imposed load moments below a predetermined magnitude.

9. A tower crane according to claim 8 wherein said tower comprises a plurality of tower sections joined end-to-end, wherein said boom comprises a plurality of boom sections joined end-to-end, wherein said load sensing means on said boom comprises load sensing devices connected between a pair of adjacent boom sections; and wherein said load sensing means on said tower comprises at least one load sensing device connected to at least one tower section.

10. crane according to claim 8 or 9 wherein said control means further comprises warning devices for receiving said output signals and for providing signals intelligible to a human operator and indicative of predetermined limits.

11. A crane according to claim 10 wherein said warning devices include visual display devices.

12. A crane according to claim 10 wherein said warning devices include audible devices.

13. A crane according to claim 8 or 9 wherein said output signals operate control devices which automatically operate said first and second drive means.

14. A crane according to claim 2 or 8 wherein said boom is a multi-section boom and wherein said loading sensing means comprises clevis pins or bolts having electro-responsive load-sensing devices therein and forming mechanical connections at joints between two adjacent boom sections.

15. A crane according to claim 14 wherein said joints are located near the base end of said boom.

16. A crane according to claim 15 wherein at least one of said adjacent boom sections is a lattice-type boom section and comprises two pairs of chord members, each pair including a lower chord member and an upper chord member, defining a respective lateral side of said boom, and wherein each of said clevis pins or bolts is located at a joint connecting one of said lower chord members to an adjacent boom section.

17. In a crane:

a support;

a boom mounted on said support and having opposite lateral sides, said boom comprising at least two separable boom sections arranged end-to-end, drive means operable to effect lateral swinging movement and luffing movement of said boom;

and control means for sensing any side load and any down load imposed on said boom, for determining the magnitude and direction of the load moment, and for providing an electrical output signal to effect operation of said drive means to move said boom to maintain said load moment below a predetermined magnitude, said control means comprising load sensing means mounted on opposite lateral sides of said boom and between said boom sections for sensing compression and tension forces occurring in said opposite lateral sides of said boom when a load is imposed on said boom, and for providing electric signals representing magnitude and direction of said load, said control means further comprising computer means for receiving and processing said electric signals from said load sensing means to ascertain the load moment and for providing said electrical output signal to operate said drive means, said computer means operating to compare said electric signals from said load sensing means to ascertain differences in the magnitude and direction thereof in order to provide an output signal indicative of any side load moment, said computer means further operating to add said electric signals to provide an output signal indicative of a total downward load moment on said boom.

18. A crane according to claim 17 wherein said load sensing devices are embodied in mechanical components which mechanically join together said two boom sections.

* * * * *